United States Patent [19]

Ichihara et al.

[11] Patent Number: 4,862,213

[45] Date of Patent: Aug. 29, 1989

[54] IMAGE FORMING APPARATUS AND METHOD

[75] Inventors: Issey Ichihara, Funabashi; Kenshi Toshimitsu, Kawasaki; Natsuki Tachibana, Yokohama, all of Japan

[73] Assignee: Kabushiki Kaisha Toshiba, Japan

[21] Appl. No.: 114,761

[22] Filed: Oct. 30, 1987

[30] Foreign Application Priority Data

Oct. 31, 1986 [JP] Japan ..... 61-259704
Oct. 31, 1986 [JP] Japan ..... 61-259713

[51] Int. Cl.[4] ..... G03G 15/08
[52] U.S. Cl. ..... 355/245; 118/657; 355/14 D
[58] Field of Search ..... 355/3 DD, 14 D; 118/657, 658; 222/DIG. 1

[56] References Cited

U.S. PATENT DOCUMENTS

| | | | |
|---|---|---|---|
| 3,954,331 | 5/1976 | Smith | 355/3 D D |
| 4,226,525 | 10/1980 | Sakamoto et al. | 355/3 D D X |
| 4,235,194 | 11/1980 | Wada et al. | 118/657 |
| 4,331,757 | 5/1982 | Tanaka et al. | 118/657 X |
| 4,382,420 | 5/1983 | Ohnuma et al. | 118/651 |
| 4,485,760 | 12/1984 | Tanaka et al. | 118/657 |

*Primary Examiner*—Fred L. Braun
*Attorney, Agent, or Firm*—Foley & Lardner, Schwartz, Jeffery, Schwaab, Mack, Blumenthal & Evans

[57] ABSTRACT

An image forming apparatus utilizing two types of toners. The first toner is of a type that causes the charge thereon to increase over time, while the second toner is a type in which the charge decreases over time. The storage chamber for the apparatus holds a two-component developing agent formed of a carrier and a first toner. In proportion to the consumption of the first toner during the printing process, the second toner is resupplied from a toner hopper to the developing agent in the storage chamber.

12 Claims, 9 Drawing Sheets

IMAGE FORMING APPARATUS AND METHOD

BACKGROUND OF THE INVENTION

The present invention relates to an image forming apparatus, such as a copying apparatus, electronic printer, etc., and more particularly, to an image forming apparatus including a developing unit for developing an electrostatic latent image, by using a two-component developing agent formed of a toner and a carrier, and a toner supply unit for replenishing the developing unit with the toner.

In an image forming apparatus, e.g., a copying apparatus, comprising a developing unit for developing an electrostatic latent image by means of a two-component developing agent formed of a toner and a carrier, a toner supply unit is usually attached to the developing unit. The supply unit is used to replenish the developing unit with the toner.

Conventionally, however, the toner resupplied by the toner supply unit is of the same composition or type as the toner previously stored in the developing unit.

According to such a conventional method of toner supply, the image density increases as finished copies increase in number, as indicated by the line graph of FIG. 1. As indicated by the line graph of FIG. 2, moreover, the amount of electric charge on the toner diminishes in proportion to the increase of the number of finished copies.

In other words, as a copying cycle advances, accompanied by rotations of a developing roller and a stirring member and stress from a leveller (doctor blade), toner film may be formed on the carrier, or otherwise, highly-charged toner particulates may be fixed to the carrier. As a result, the carrier loses its primary effect of retaining electric charge of a predetermined level on the toner through its friction with the toner. Thus, it is impossible to obtain a proper amount of charge for the copying cycle.

Accordingly, the image density may be increased too much, or the inside of the apparatus may be soiled by bloom or scattered toner. Otherwise, toner particles of the opposite polarity, which cannot be used for the development, may increase, thus adding to toner consumption. Conventionally, therefore, the developing agent is lowered in life performance, and is replaced periodically. Alternatively, the developing agent is increased in quantity.

Referring now to FIGS. 3 and 4, the above description will be supplemented. All of the individual charged toner particles are not conducive to the development process. At least, toner particles of the opposite polarity cannot serve their purpose. In the vicinity of point 0 in FIG. 3, the toner particles have little, if any electric charge, so that they cannot adhere to the electrostatic latent image. This results in scattering of the toner particles. This tendency can be ascertained by comparing the graphs of FIGS. 3 and 4. As seen from these graphs, even if a toner of the same composition as the toner stored previously in the developing unit is used for replenishment, the amount of charge thereon varies gradually as the copying cycle advances. This is because the friction charging of the resupplied toner changes gradually.

Conventionally, as mentioned before, this problem is settled by using a short-life developing agent, which should be replaced periodically, or by increasing the quantity of the developing agent. However, such a counter-measure is not very economical, and entails an increase in apparatus size.

SUMMARY OF THE INVENTION

The object of the present invention is to provide an image forming apparatus capable of preventing a spread of the distribution of the amount of toner charge, without any change or modification in fundamental arrangement, so that the initial distribution can be maintained, and images can be formed stably for a long period of time.

According to an aspect of the present invention, there is provided an image forming apparatus, which comprises storage means for previously storing a two-component developing agent containing a carrier and a first toner; replenishment means for resupplying a second toner to the two-component developing agent in the storage means in proportion to the consumption of the first toner, the first and second toners being of different types; and developing means for developing an electrostatic latent image by means of the two-component developing agent.

According to another aspect of the invention, there is provided an image forming apparatus, which comprises a developing unit for visualizing an electrostatic latent image by means of a two-component developing agent formed of a toner and a carrier, and a toner supply unit for resupplying a toner to the developing unit, the toner resupplied from the toner supply unit being different in composition from the toner previously stored in the developing unit.

According to this arrangement, the second toner of the different composition is resupplied to the developing agent in accordance with the consumption of the first toner in the developing agent previously stored in the storage means of the developing unit. Thus, a satisfactory charge distribution characteristic can be maintained compulsorily, and the developing agent can enjoy a prolonged life. In consequence, images can be formed stably for a long period of time, without changing the fundamental arrangement of the apparatus.

DETAILED DESCRIPTION OF THE PREFERRED EMBODIMENT

An embodiment of the present invention will now be described in detail with reference to the accompanying drawings.

Figure 5:
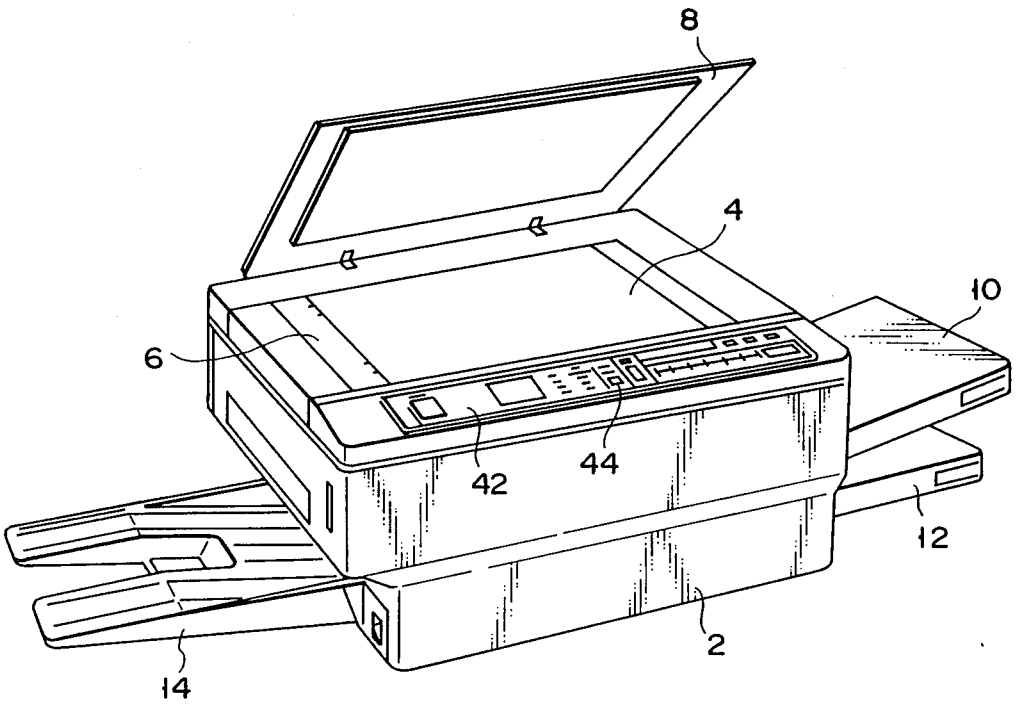
FIG. 5 is a perspective view showing an outline of a two-color copying machine as an example of an image forming apparatus according to the present invention.

In FIG. 5, numeral 2 designates a housing of a copying machine as an image forming apparatus according to the present invention. An original table (transparent glass) 4 for supporting an original thereon is disposed on the top surface of housing 2. Scale 6 is provided on one end side of table 4. It serves as a reference mark for placement of the original. Swingable original cover 8 is supported beside table 4. Upper and lower cassettes 10 and 12 are attached to one side of the bottom portion of housing 2, and receiving tray 14 is fixed to the other side.

Figure 6:
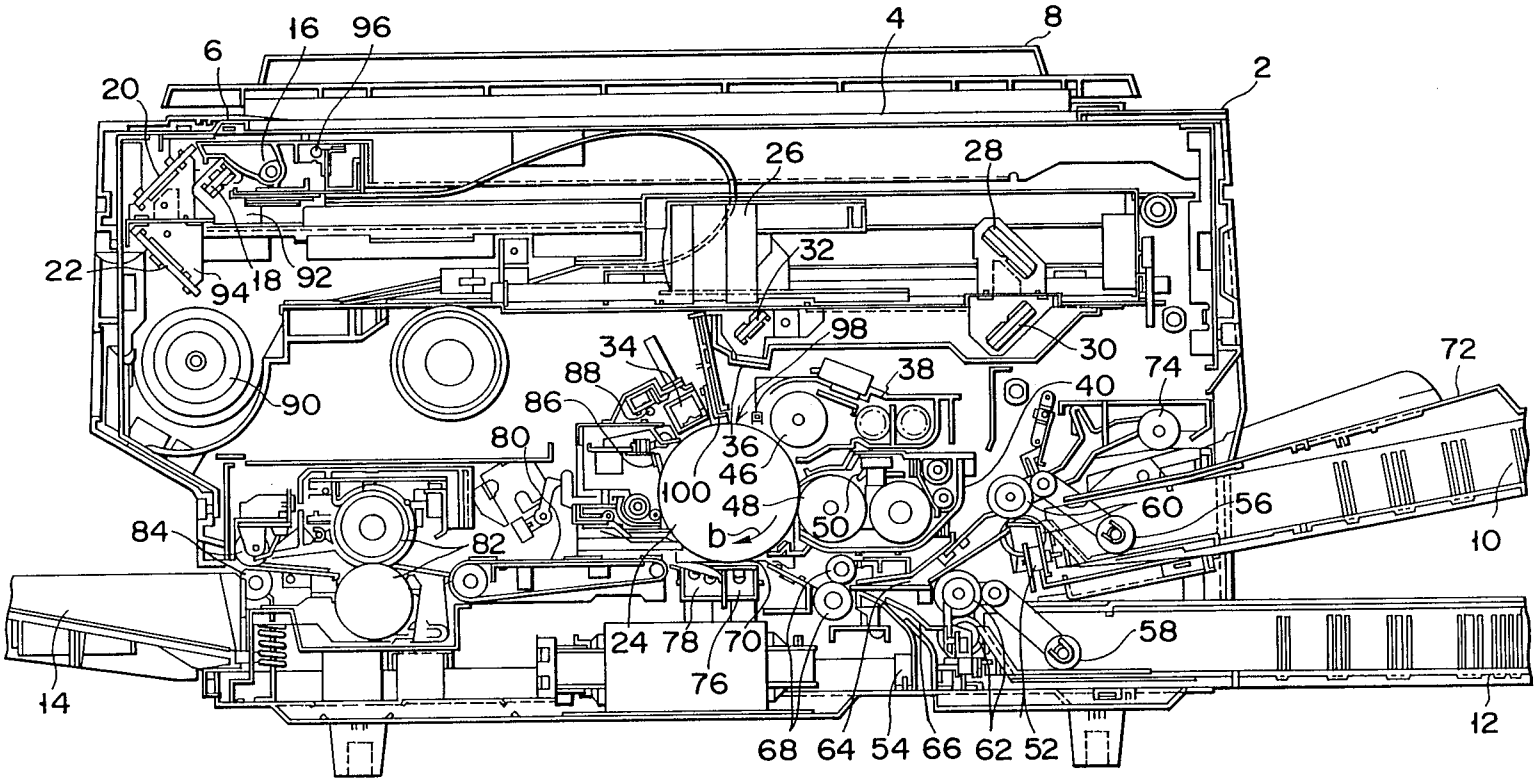
FIG. 6 is a sectional view schematically showing the internal structure of the apparatus of FIG. 5.

As shown in FIG. 6, the original set on original table 4 is exposed to be scanned by an optical system, including exposure lamp 16 and mirrors 18, 20 and 22, reciprocating along the underside of table 4. In doing this, the length of an optical path, extending from the original to photoconductive drum 24 (mentioned later), is kept constant, so that lamp 16 and mirror 18 are moved at a speed half that of mirrors 20 and 22. Reflected light from the original, scanned by the optical system, i.e., illuminated by the exposure lamp, is reflected by mirrors 18, 20 and 22, and then transmitted through lens block 26 for scale change. Thereafter, the light is further reflected by mirrors 28, 30 and 32, and then guided to drum 24 ($\phi = 78$ mm). Thereupon, a developed image is formed on the surface of drum 24.

Photoconductive drum 24 rotates in the direction of arrow b, at the same speed as the speed of original scanning by the optical system. The surface of drum 24 is first charged by main charger 34. Thereafter, it is exposed to the light which is transmitted thereto through lens 26, mirrors 18, 20 and 22, and slit 36 after being reflected by the original. Thereupon, an electrostatic latent image is formed on the surface of drum 24. Toner T is adhered to the latent image by means of first or second developing unit 38 or 40. As a result, the latent image is visualized, thus forming a toner image. For example, first unit 38 is stored with red toner Ta, which is not frequently used, while second unit 40 is stored with black toner Tb, which is used with relatively high frequency. Developing units 38 and 40 are driven alternatively.

As shown in FIG. 5, control panel 42 is mounted on the top surface of housing 2. Color change key (developer selection key) 44 is attached to panel 42. First or second developing unit 38 or 40 is selected for development by operating key 44. Normally, the electrostatic latent image on the surface of photoconductive drum 24 is developed, for example, by means of second unit 40, using black toner Tb. When a color designation is given by operating color change key 44, the latent image on the drum surface is developed by means of first unit 38.

In the normal state, as shown in FIG. 6, toner Ta on an exposed portion of developing roller 46 in first developing unit 38 is scraped off by means of a blade (not shown). Thus, red toner Ta is kept from coming into contact with photoconductive drum 24. When the color designation is given, on the other hand, toner Tb on an exposed portion of developing roller 48 in second developing unit 40 is scraped off by means of blade 50. Thus, black toner Tb is prevented from touching drum 24.

First and second developing units 38 and 40 are removably mounted in housing 2. Color indicators attached to color change key 44 indicate the colors of toners Ta and Tb in first and second units 38 and 40, individually. The color indication depends, for example, on the state of connection between a connector pin (not shown) on the side of housing 2 and connector pins (not shown) attached to units 38 and 40.

Upper and lower cassettes 10 and 12 are removably attached to the one side portion of housing 2. One of cassettes 10 and 12 is selected by means of a selection key (not shown) of control panel 42. Cassette-size detection switches 52 and 54 are provided at the mounting portions of cassettes 10 and 12, respectively. The cassette size is displayed on panel 42 in accordance with the result of detection by switches 52 and 54. Switches 52 and 54 are each composed of a plurality of microswitches, which are turned on and off as cassettes 10 and 12 of different sizes are inserted into the apparatus.

Paper sheets are taken out one by one from upper or lower cassette 10 or 12 by means of paper-supply roller 56 or 58 and feed rollers 60 or 62. Each sheet is guided to aligning rollers 68 via sheet guide path 64 or 66. Then, the sheet is delivered to transfer section 70 by means of aligning rollers 68. Rollers 68 are driven in synchronism with the rotation of photoconductive drum 24.

Sheet-bypass guide 72 is attached to the top portion of upper cassette 10. A paper sheet inserted manually through guide 72 is delivered to feed rollers 60 by means of sheet-bypass roller 74. Then, the sheet is transported to transfer section 70 in the same manner as each sheet fed from cassette 10.

Upon reaching transfer portion 70, the sheet is attracted electrostatically to the surface of photoconductive drum 26 which faces transfer charger 76. In this state, the toner image on drum 24 is transferred to the surface of the sheet by the agency of charger 76. Thereafter, the sheet, with the transferred image thereon, is separated from drum 24 by means of separation charger 78. The separated sheet is transported toward fixing rollers 82 by means of conveyor belt 80. As the sheet passes between rollers 82, the toner image is fixed on the sheet. After the fixation, the sheet is discharged onto tray 14 outside housing 2 by means of exit rollers 84.

After the toner image is transferred to the sheet, toner T remaining on the surface of photoconductive drum 24 is removed by means of cleaner 86. After the removal of the residual toner, a residual image on the surface of drum 24 is erased by means of discharge lamp 88. Thus, the drum surface is restored to its initial state.

Cooling fan 90 and first and second carriages 92 and 94 are arranged within housing 2. Fan 90 serves to prevent the temperature inside the housing from rising. Exposure lamp 16 and mirror 18 are mounted on first carriage 92, while mirrors 20 and 22 are mounted on second carriage 94.

First carriage 92 is provided with spot light source 96, which is movable at right angles to the traveling direction of carriage 92. Light source 96 includes a light emitting element, which emits a spot light toward the original table. The spot light is used to designate the range of original portion to be erased, for example.

Erasure array 100 is provided between main charger 34 and exposed portion 98 of photoconductive drum 24. Array 100 includes a plurality of light emitting elements which are arranged along the axis of drum 24. In partially erasing an original image, the emitting elements of array 100 are turned on corresponding to erasure areas designated by spot light source 96, for example. Thus, the surface potential of drum 24 is removed. If the de-electrified surface portion of drum 24 is exposed to the original image, thereafter, no electrostatic latent image can be formed on that portion. Thus, no copy image can be formed corresponding to the erasure areas of the original image.

Figure 7:
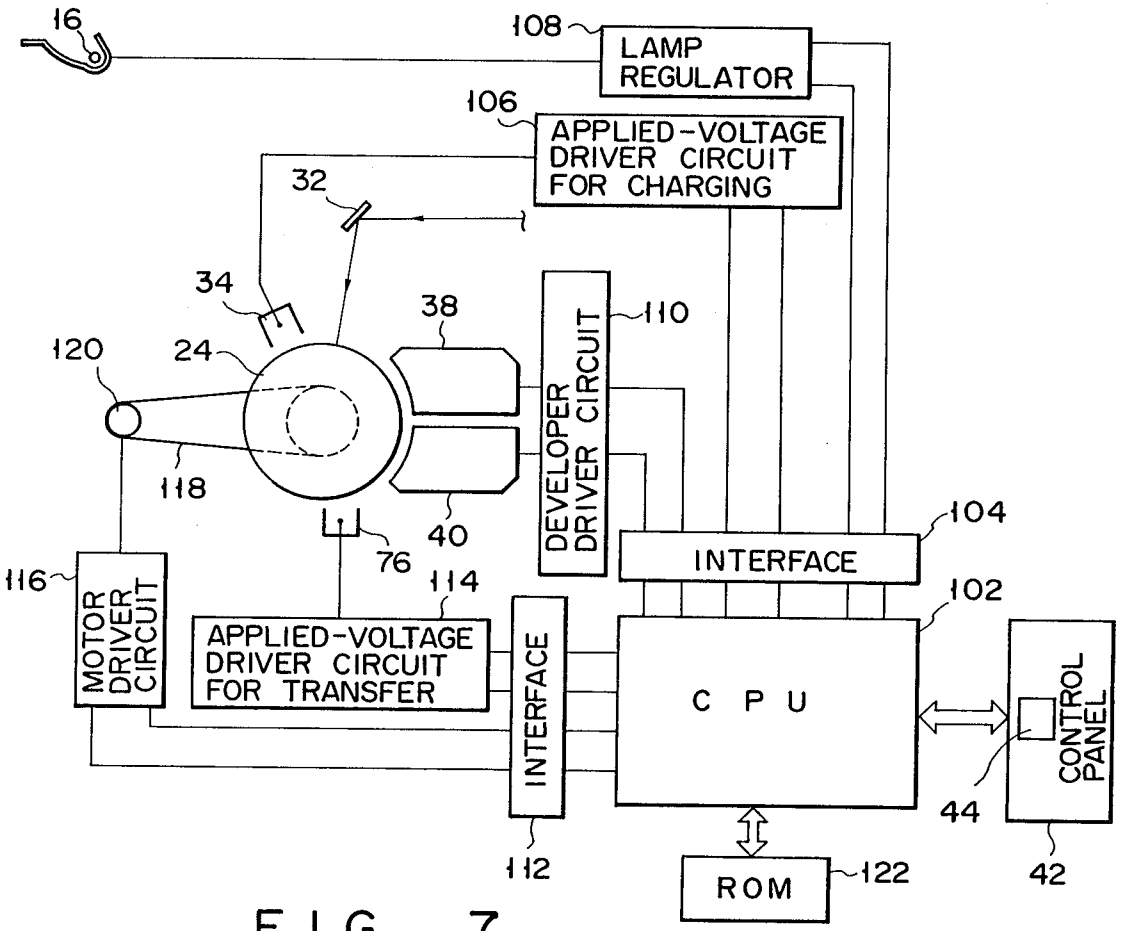
FIG. 7 is a diagram showing electric circuits of the apparatus of FIG. 5.

FIG. 7 shows electric circuits of the principal part of the apparatus. Numeral 102 designates a CPU, which is connected with applied-voltage driver circuit 106 for charging, lamp regulator 108, and developer driver circuit 110 through interface 104. Circuit 106 and regulator 108 serve to drive main charger 34 and exposure lamp 16, respectively. Circuit 110 is used to drive first and second developing units 38 and 40. Further, applied-voltage driver circuit 114 for transfer and motor driver circuit 116 are connected to CPU 102 through interface 112. Circuit 114 drives transfer charger 76, while circuit 116 drives DC motor 120 which is used to drive photoconductive drum 24 with the aid of belt 118. Also, control panel 42 and ROM 122 are connected to CPU 102. Furthermore, CPU 102 is connected, through an interface (not shown), with driver circuits (not shown) which individually drive separation charger 78, fixing rollers 82, cleaner 86, discharge lamp 88, spot light source 96, etc.

Applied-voltage driver circuit 106 for charging includes a transformer whose secondary winding, for example, is connected to main charger 34, a resistor connected to the primary winding of the transformer, and a switching circuit for selecting the resistance value of the resistor. The resistor is used to change the value of current flowing through the primary winding. Applied-voltage driver circuit 114 for transfer includes a transformer whose secondary winding, for example, is connected to transfer charger 76, a resistor connected to the primary winding of the transformer, and a switching circuit for selecting the resistance value of the resistor. The resistor is used to change the value of current flowing through the primary winding. Lamp regulator 108 includes a Triac and a circuit for changing the angle of conduction thereof. Motor driver circuit 116 includes an oscillator circuit which generates signals corresponding individually to first and second developing units 38 and 40.

When a copy key (not shown) of control panel 42 is operated, CPU 102 determines which of first and second developing units 38 and 40 is selected by means of color change key 44.

If it is concluded that second developing unit 40 is selected, that is, in the case of normal copying operation using black toner Tb, CPU 102 supplies predetermined drive signals, corresponding to second unit 40, to motor driver circuit 116, lamp regulator 108, applied-voltage driver circuits 106 and 114 for charging and transfer, etc.

In this case, motor driver circuit 116 drives DC motor 120 in response to a signal of a predetermined frequency, which is delivered from the oscillator circuit in response to a signal from CPU 102. Thereupon, photoconductive drum 24 is rotated at a peripheral speed of 160 mm/sec, for example. Applied-voltage driver circuit 106 for charging selects the resistance value in response to a signal from CPU 102, by means of its switching circuit, and applies a voltage corresponding to the selected resistance value to main charger 34. Likewise, applied-voltage driver circuit 114 for transfer selects the resistance value in response to a signal from CPU 102, by means of its switching circuit, and applies a voltage corresponding to the selected resistance value to transfer charger 76. Lamp regulator 108 changes the conduction angle of the Triac in response to a signal from CPU 102, and applies a voltage corresponding to the conduction angle to exposure lamp 16.

Thus, the process time and speed are set to optimum values corresponding to second developing unit 40 storing black toner Tb. At the same time, the surface potential of photoconductive drum 24 charged by main charger 34, the field strength between between drum 24 and the sheet provided by transfer charger 76, and the value of exposure by exposure lamp 16 are adjusted to their optimum values.

Meanwhile, CPU 102 delivers predetermined signals to a driver circuit for the optical system, including exposure lamp 16 and mirrors 18, 20 and 22, and a driver circuit for aligning rollers 68. Thus, the original and the sheet are scanned and transported, respectively. Moreover, second developing unit 40, separation charger 78, fixing rollers 82, cleaner 86, and discharge lamp 88 are driven individually in response to signals from CPU 102.

If it is concluded that first developing unit 38 is selected by means of color change key 44, that is, in the case of copying operation using red toner Ta, CPU 102 supplies predetermined drive signals, corresponding to first unit 38, to motor driver circuit 116, lamp regulator 108, applied-voltage driver circuits 106 and 114 for charging and transfer, etc.

In this case, motor driver circuit 116 drives DC motor 120 in response to a signal of a predetermined frequency, which is delivered from the oscillator circuit in response to a signal from CPU 102. This frequency is lower than that of the signal delivered for second developing unit 40. Thereupon, photoconductive drum 24 is rotated at a peripheral speed of 160 mm/sec, for example. Applied-voltage driver circuit 106 for charging selects the resistance value in response to a signal from CPU 102, by means of its switching circuit, and applies a voltage corresponding to the selected resistance value to main charger 34. Likewise, applied-voltage driver circuit 114 for transfer selects the resistance value in response to a signal from CPU 102, by means of its switching circuit, and applies a voltage corresponding to the selected resistance value to transfer charger 76. Lamp regulator 108 changes the conduction angle of the Triac in response to a signal from CPU 102, and applies a voltage corresponding to the conduction angle to exposure lamp 16.

Thus, the process time and speed are set to optimum values corresponding to first developing unit 38 storing red toner Ta. At the same time, the surface potential of photoconductive drum 24 charged by main charger 34, the field strength between drum 24 and the sheet provided by transfer charger 76, and the value of exposure by exposure lamp 16 are adjusted to their optimum values.

Meanwhile, CPU 102 delivers predetermined signals to the driver circuit for the optical system, including exposure lamp 16 and mirrors 18, 20 and 22, and the driver circuit for aligning rollers 68. Thus, the original and the sheet are scanned and transported, respectively, at a speed corresponding to the peripheral speed of photoconductive drum 24. Moreover, first developing unit 38, separation charger 78, fixing rollers 82, cleaner 86, and discharge lamp 88 are driven individually in response to signals from CPU 102.

According to the arrangement described above, the rotating speed and surface potential of photoconductive drum 24, the field strength at transfer section 70, and the exposure value of exposure lamp 16 are changed, depending on the selected developing unit. Thus, copying operation is performed under optimum conditions which depend on the developing unit used and its location, and the properties of toner T stored therein.

In other words, photoconductive drum 24 is rotated at different speeds for first and second developing units 38 and 40, so that the process time and speed are changed, depending on the developing unit used. As the process time and speed vary in this manner, moreover, voltages applied to exposure lamp 16, main charger 34, and transfer charger 76 are changed correspondingly. Thus, satisfactory images of the same quality can be obtained without regard to the developing unit used, whether it is first unit 38 or second unit 40.

Since the optimum process time and speed can be used for selected first or second developing unit 38 or 40, so that first unit 38, which contains red toner Ta, for example, and is expected to be used less frequently, can be reduced in size. In other words, each developing unit can be sized depending on its frequency of use, so that the image forming apparatus can be reduced in general size.

Figure 8:
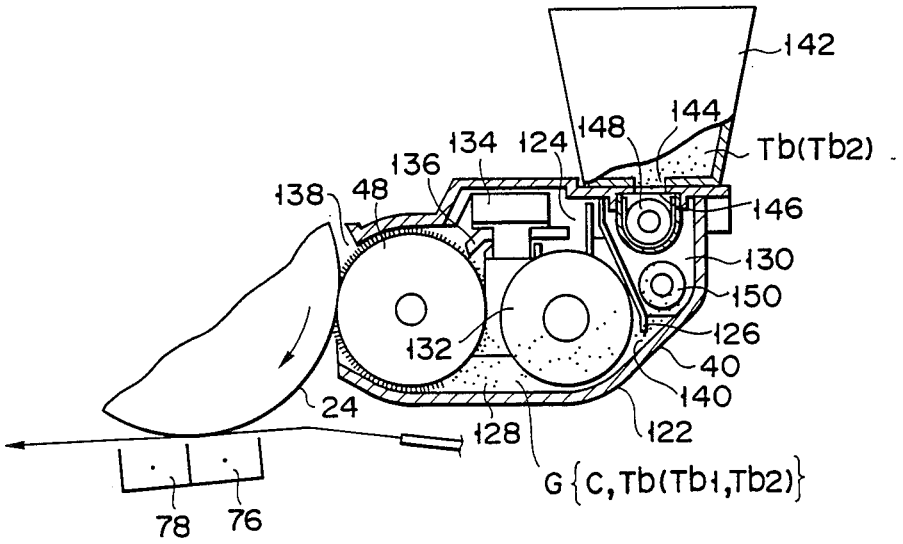
FIG. 8 is a sectional view of a developing unit used in the apparatus of FIG. 5.

As shown in FIG. 8, second developing unit 40 develops the electrostatic latent image with use of two-component developing agent G. Unit 40 includes case 122 in which storage chamber 124 is defined. Partition wall 126 divides chamber 124 into two parts, first and second storage sections 128 and 130.

First storage section 128 is stored previously with two-component developing agent G which is formed of carrier C and toner Tb. Toner Tb, which is negative in polarity, is contained in developing agent G at the rate of 3 to 5% by weight. Arranged in section 128 are developing roller 48, stirring member 132, toner content detector 134, leveller (doctor blade) 136, etc. Part of the peripheral surface of roller 48 is exposed through opening 138 of case 122, thus facing photoconductive drum 24.

Second storage section 130 communicates with first storage section 128 by means of aperture 140 at the lower portion of partition wall 126. Toner hopper 142 is detachably mounted on the top of case 122. Toner Tb for replenishment is stored in hopper 142. Toner supply port 144 is bored through the bottom wall of hopper 142. Case 122 has toner receiving port 146 which corresponds to port 144. Toner Tb in hopper 142 is supplied through ports 144 and 146 to second storage section 130. Toner feed mechanism 148 is provided inside the upper portion of section 130. Mechanism 148 serves to guide toner Tb from hopper 142 into section 130, uniformly with respect to the longitudinal direction of photoconductive drum 24 and depending on the consumption of toner Tb. Stirring member 150 is provided at the lower portion of mechanism 148.

Developing agent G is caused to adhere, in the form of a brush, to the peripheral surface of developing roller 48 by means of lines of magnetic force produced by a magnet (not shown) which is contained in roller 48. As roller 48 rotates, the brush of developing agent G is rubbed continuously on the surface of photoconductive drum 24. As a result, toner Tb in the magnetic brush of agent G is transferred to the electrostatic latent image on the drum surface, thereby developing the latent image.

The amount of toner Tb contained in developing agent G in first storage section 128 is detected by means of toner content detector 134. When the toner content reaches a predetermined level, a replanishment signal is fed to a drive system for toner feed mechanism 148. Thus, toner Tb is resupplied in accordance with its previous consumption.

Figure 9:
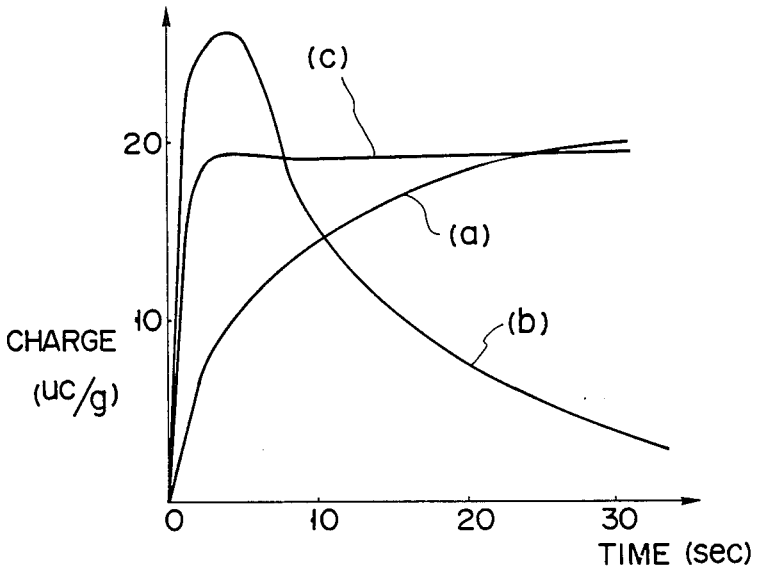
FIG. 9 is a graph showing the relationship between the amount of electric charge and time with respect to first and second toners used in the developing unit of the apparatus of FIG. 5.

Second toner Tb2 (which is part of toner Tb and is supplied from toner hopper 142) is different in type from first toner Tb1 (which is also part of toner Tb and is previously stored in first storage section 128). In other words, first and second toners Tb1 and Tb2 are formed of materials of different charging systems. The properties of toners Tb1 and Tb2 are shown in FIG. 9, by way of example. In FIG. 9, curves (a), (b) and (c) represent the characteristics of first toner Tb1, second toner Tb2, and a mixture of toners Tb1 and Tb2, respectively. As can be seen from FIG. 9, the amount of charge on the first toner increases with time, while the amount of charge on the second toner decreases with time. Thus, the distribution of electric charge on toner Tb in developing agent G is restrained from spreading, and is kept in its initial state. Thus, images can be formed stably for a long period of time.

Carrier C is a Ca—Zn—based ferrite oxide in the form of dark reddish, silver-gray spherical particles. A reticulate pattern is formed on the surface of carrier C. The peak value of the mean particle size of carrier C ranges from 70 to 100 μm, and the specific gravity of the carrier ranges from 2.5 to 2.8.

A toner of type (a) is used as first toner Tb1. It is a black toner formed of styrene-acrylate resin and a pigment composed mainly of carbon black. The (a)-type toner has its mean particle size ranging from 10 to 11 μm, specific gravity from 0.3 to 0.35, and glass transition point from 60° to 70° C.

Toners of types (b) and (c) are used for second toner Tb2. The (b)-type toner is a mixture of the (a)-type toner and 0.3 to 0.5% additive by weight. The (c)-type toner is a mixture of the (a)-type toner and 1% additive.

The aforesaid additive is a one-component magnetic toner which is formed of styrene-acrylate resin and a pigment obtained by mixing carbon black with magnetic powder. The mean particle size of this additive ranges from about 10 to 11 μm.

Figure 10:
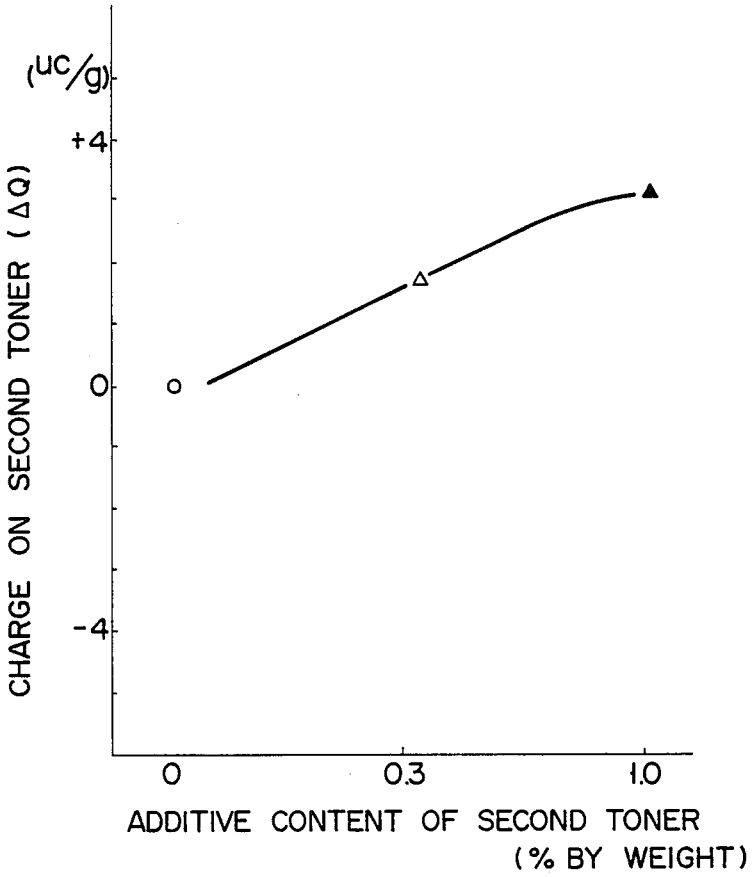
FIG. 10 is a graph showing the relationship between the amount of charge and the additive content of the second toner used in the developing unit of the apparatus of FIG. 5.

If the (b)- and (c)-type toners, which are different in additive content, are supplied as second toner Tb2, the amount of charge is greater than in the case the (a)-type toner is used initially, as shown in FIG. 10.

Developing was tried with the (b)- or (c)-type toner previously stored together with carrier C in first storage section 128. Thereupon, the image density proved poor from the start (for the first copy image).

Figure 11:
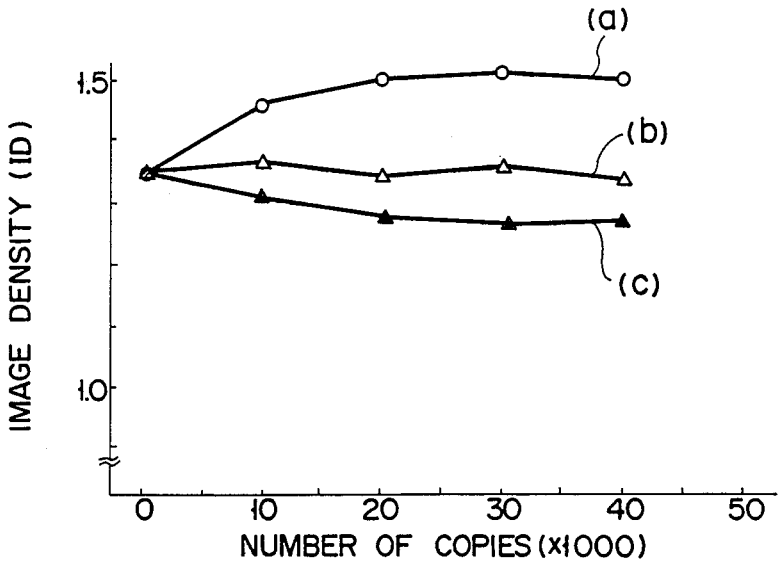
FIG. 11 is a graph showing the relationship between the number of copies and the image density obtained when a toner of a composition different from that of the toner previously stored in the storage section of the developing unit is resupplied, as compared with the equivalent relationship obtained when the toner of the same composition as the previously stored toner is resupplied.
Figure 12:
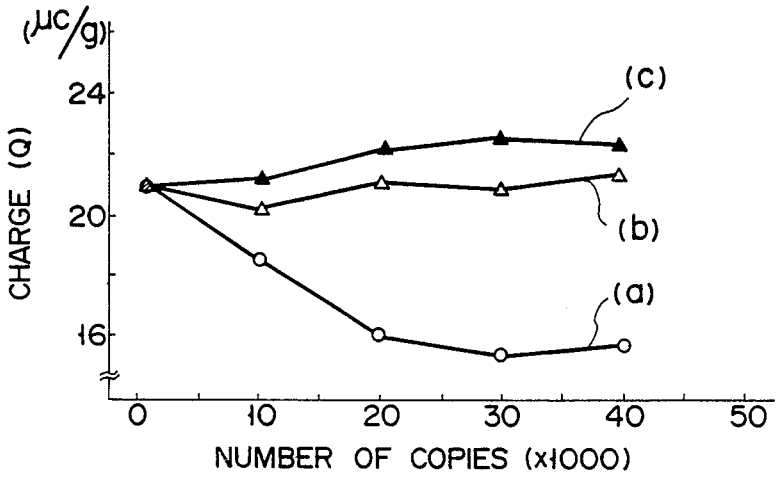
FIG. 12 is a graph showing the relationship between the number of copies and the amount of charge obtained when the toner of the composition different from that of the previously stored is resupplied, as compared with the equivalent relationship obtained when the toner of the same composition as the previously stored toner is resupplied.

Developing was tried with the (a)-type toner previously stored together with carrier C in first storage section 128. Cases in which the (b)- and (c)-type toners were resupplied as the (a)-type toner was consumed, as indicated by curves (b) and (c), respectively, in FIGS. 11 and 12, was compared with a case in which the (a)-type toner was resupplied, as indicated by curves (a). Thereupon, it was indicated that stable image density and charge amount can be obtained without regard to the number of finished copies. Also, the life of the developing agent can be lengthened.

Figure 13:
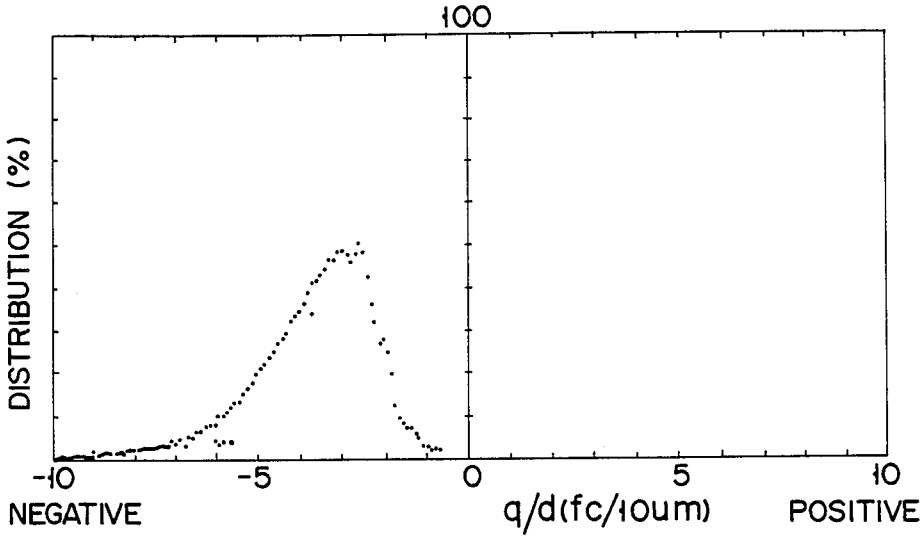
FIG. 13 is a graph showing a transition of the distribution of the amount of toner charge obtained when the toner of the same composition as the previously stored toner is resupplied.

FIG. 13 shows the distribution of the amount of charge on toner T obtained 40 minutes after the start of an image forming process. This distribution is substantially the same as that of the initial amount of toner charge shown in FIG. 3.

The mechanism of frictional charging has not yet been analyzed theroretically, and has hardly been explained. Therefore, the causes for the above result are not clear. The innovation of the present invention can, however, be fully verified by this test result.

Figure 1:
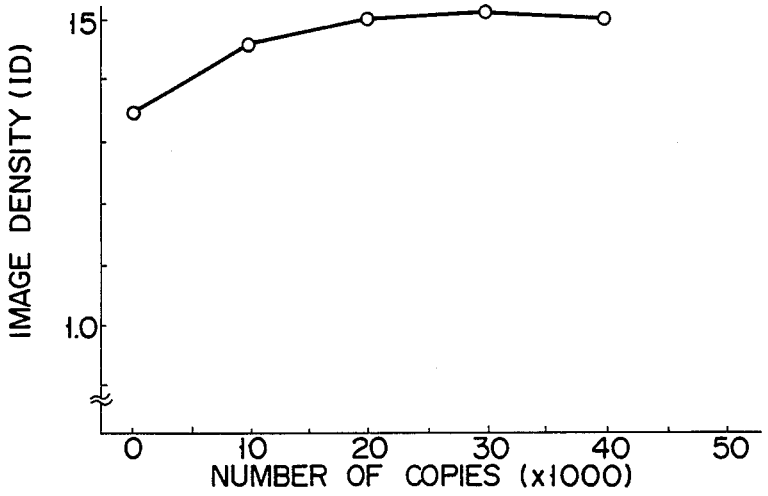
FIG. 1 is a graph showing the relationship between the number of finished copies and the image density obtained when a toner of the same composition as the one previously stored in a storage section of a developing unit is resupplied.
Figure 2:
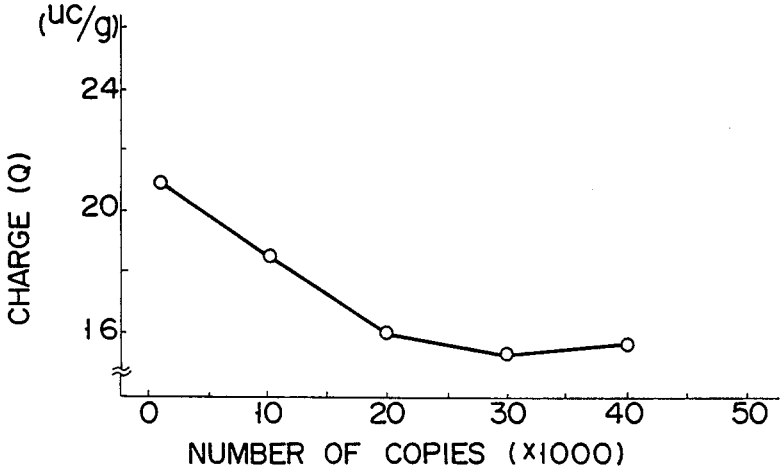
FIG. 2 is a graph showing the relationship between the number of finished copies and the amount of toner charge obtained when the toner of the same composition as the one previously stored in the storage section of the developing unit is resupplied.
Figure 3:
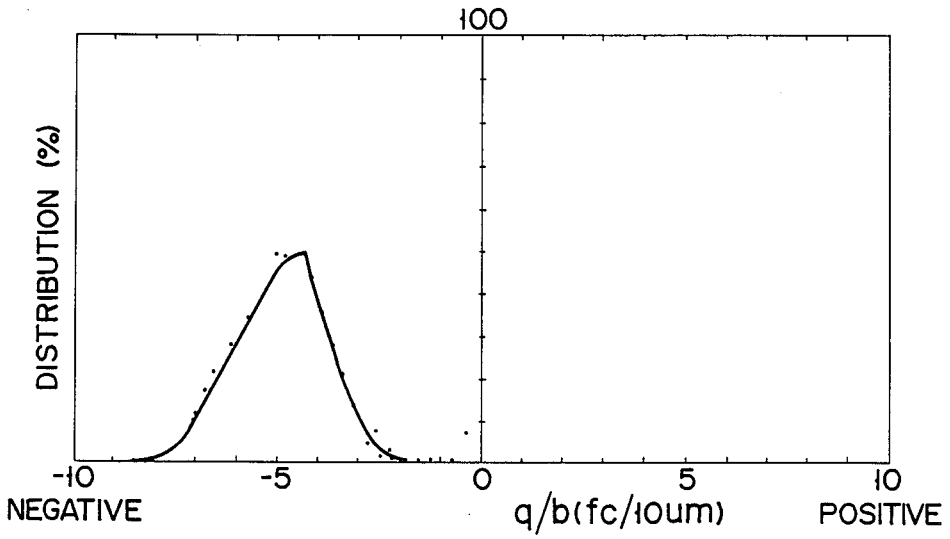
FIG. 3 is a graph showing the distribution of the initial amount of toner charge.
Figure 4:
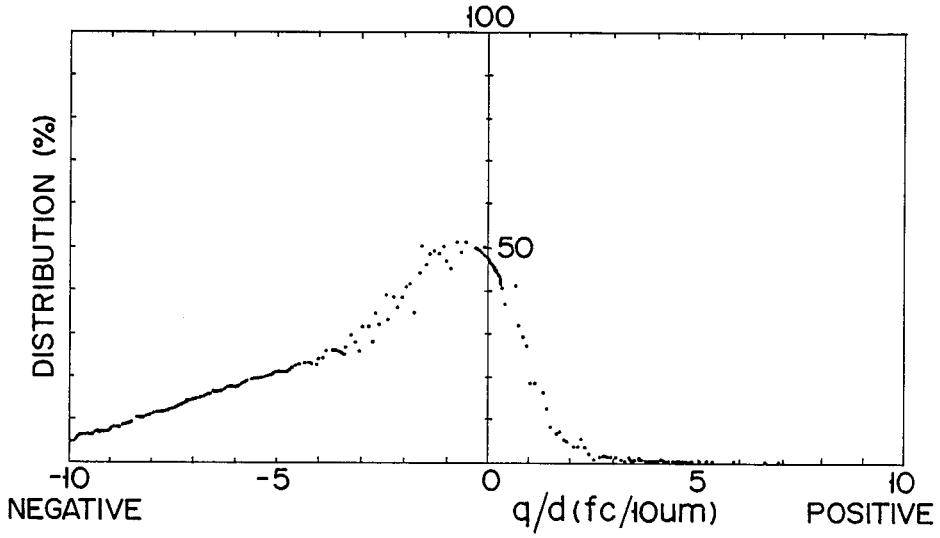
FIG. 4 is a graph showing a transition of the distribution of the amount of toner charge obtained when the toner of the same composition as the one previously stored in the storage section of the developing unit is resupplied.

The toner of the charge distribution different from that of the toner shown in FIG. 3 is fed into the storage section, at a ratio varying with the progress of the copying cycle. Therefore, the state of frictional charging fluctuates, and the electric charge is well balanced. This is assumed to be the reason for the aforementioned result.

In the embodiment described above, second toner Tb2 is formed by mixing an additive, such as a one-component magnetic toner, with, for example, first toner Tb1 ((a)-type toner). Alternatively, however, toner Tb2 may be formed by impregnating a toner material with an additive. The mixture ratio of the additive or the additive content is not limited to the values described in connection with the above embodiment. First and second toners Tb1 and Tb2 may be of any types, provided they have different characteristics permitting charge correction.

Like second developing unit 40, first developing unit 38 is stored previously with first toner Ta1, and is supplied with second toner Ta2 from a toner hopper (not shown). Toners Ta1 and Ta2 are not shown. A detailed description of the construction of unit 38 is omitted herein.

In the aforementioned embodiment, the two-color copying machine is described as an example of the apparatus of the present invention. However, the invention is not limited to this, and may be also applied to multicolor copying machines, such as three-color versions, and laser printers.

In the embodiment described above, moreover, red and black toners Ta and Tb are stored in first and second developing units 38 and 40, respectively. However, the toners stored in the first and second developing units are not limited in color. For example, blue or green toner may be used instead.

In the above embodiment, moreover, the voltages applied individually to exposure lamp 16, main charger 34, and transfer charger 76 are changed depending on the selected developing unit, first or second. Besides these applied voltages, however, voltages applied to discharge lamp 88 and separation charger 78, for example, may be changed.

In the above embodiment, furthermore, original table 4 of the copying machine is of a fixed type. Alternatively, however, table 4 may be a movable table which should be combined with a fixed optical system, including exposure lamp 16 and mirrors 18, 20 and 22.

What is claimed is:

1. An image forming apparatus comprising:

storage means for initially storing a two-component developing agent containing a carrier and a first toner;

replenishment means for continuously resupplying a second toner to the two-component developing agent in the storage means in proportion to the consumption of the first toner, said first and second toners being of different types, the amount of charge on the first toner increasing with time and the amount of charge on the second toner decreasing with time; and developing means for developing an electrostatic latent image by means of the two-component developing agent.

2. The image forming apparatus according to claim 1, wherein said first and second toners have different charging characteristics.

3. The image forming apparatus according to claim 1, wherein said first and second toners are formed of materials of different rank of frictional series.

4. The image forming apparatus according to claim 1, wherein the mixture of said first and second toners is allowed to have a substantially uniform charging characteristic even after the lapse of time by resupplying the second toner in proportion to the consumption of the first toner.

5. The image forming apparatus according to claim 1, wherein said second toner is formed of the mixture of the first toner and an additive.

6. The image forming apparatus according to claim 5, wherein said additive is formed of a one-component magnetic toner.

7. The image forming apparatus according to claim 6, wherein the mean particle diameter of said second toner ranges from 5 to 20 μm.

8. The image forming apparatus according to claim 5, wherein the additive content of said second toner is 1% or less by weight.

9. The image forming apparatus according to claim 1, wherein the mean particle diameter of said first toner ranges from 5 to 20 μm.

10. The image forming apparatus according to claim 1, wherein said storage means includes means for stirring the first and second toners.

11. An image forming apparatus comprising:

storage means for storing a two-component developing agent formed of a toner and a carrier;

developing means for developing an electrostatic latent image by means of the two-component developing agent stored in the storage means;

replenishment means for continually resupplying the toner to the two-component developing agent in proportion to the amount of toner in the developing agent consumed by the developing means;

a first toner used as part of the toner of the two-component developing agent and is initially stored in the storage means; and a second toner used as part of the toner of the two component developing agent and is supplied to the storage means by the replenishment means, said first and second toners being of different types, the amount of charge on the first toner increasing with time and the amount of charge on the second toner decreasing with time.

12. An image forming method for developing an electrostatic latent image by means of a two-component developing agent containing a first toner and a carrier; including the step of:

developing the electrostatic latent image by means of a two-component developing agent containing a first toner, a second toner, and a carrier, said first and second toners being of different types, said second toner being continuously resupplied to the two-component developing agent in proportion to the consumption of the first toner, the first and second toner contents of the developing agent decreasing and increasing, respectively, with developing time, while the amount of charge on the first toner increases with time and the amount of charge on the second toner decreases with time.

* * * * *